US012594507B1

(12) United States Patent
Schmid

(10) Patent No.: US 12,594,507 B1
(45) Date of Patent: Apr. 7, 2026

(54) TOY VEHICLE LAUNCHER

(71) Applicant: Mattel, Inc., El Segundo, CA (US)

(72) Inventor: Paul Schmid, Ojai, CA (US)

(73) Assignee: MATTEL, INC., El Segundo, CA (US)

( * ) Notice: Subject to any disclaimer, the term of this patent is extended or adjusted under 35 U.S.C. 154(b) by 0 days.

(21) Appl. No.: 19/003,319

(22) Filed: Dec. 27, 2024

(51) Int. Cl.
*A63H 17/00* (2006.01)
*A63H 18/02* (2006.01)
*A63H 29/04* (2006.01)

(52) U.S. Cl.
CPC ..... *A63H 17/008* (2013.01); *A63H 18/026* (2013.01); *A63H 29/04* (2013.01)

(58) Field of Classification Search
CPC ..... A63H 17/008; A63H 18/026; A63H 29/04
See application file for complete search history.

(56) References Cited

U.S. PATENT DOCUMENTS 3,263,362 A * 8/1966 La Falce ..... A63H 1/12 446/259
3,693,282 A * 9/1972 Adicks ..... A63H 17/008 446/430
3,877,169 A * 4/1975 Munday ..... A63H 18/14 463/64
3,908,303 A * 9/1975 McKay ..... A63H 18/14 273/129 R
4,016,674 A * 4/1977 Resnick ..... A63H 18/026 446/429
4,108,437 A * 8/1978 DeAnda ..... A63H 17/008 463/64
4,345,402 A * 8/1982 Hanson ..... A63H 17/008 124/31
4,642,066 A * 2/1987 Kennedy ..... A63H 17/008 446/420
4,690,658 A * 9/1987 Crosson ..... A63H 17/008 124/79
5,370,571 A * 12/1994 Bosch ..... A63H 17/008 446/268
5,711,285 A * 1/1998 Stewart ..... F41B 11/642 124/67
10,857,474 B2 * 12/2020 Schmid ..... A63H 17/008
(Continued)

FOREIGN PATENT DOCUMENTS

WO WO-9201497 A1 * 2/1992 ..... A63H 18/028

*Primary Examiner* — Eugene L Kim
*Assistant Examiner* — Alyssa M Hylinski
(74) *Attorney, Agent, or Firm* — Edell, Shapiro & Finnan, LLC

(57) ABSTRACT

A toy vehicle launcher assembly for launching a toy vehicle includes a housing and a launcher that is at least partially disposed in the housing. The launcher includes a load mechanism, an actuator mechanism, and a push mechanism. The load mechanism includes a first arm with a handle portion and a second arm with an engagement extension. The handle portion is configured to pivot along a first axis to move the engagement extension and the length of the first arm is longer than the length of the second arm. The actuator mechanism includes a catch. The push mechanism includes a launching member having a first end for engaging with the catch and a second end opposite the first end for engaging a toy vehicle. Rotating the handle portion of the load mechanism towards the push mechanism causes the engagement extension to pull the launching member laterally towards the actuator mechanism.

20 Claims, 15 Drawing Sheets

(56) References Cited

U.S. PATENT DOCUMENTS

| | | | | |
|---|---|---|---|---|
| 2014/0099859 | A1* | 4/2014 | Weil | A63H 13/04<br>446/435 |
| 2019/0060772 | A1* | 2/2019 | Hamel | A63H 17/008 |
| 2020/0360828 | A1* | 11/2020 | Han | A63H 18/026 |

* cited by examiner

TOY VEHICLE LAUNCHER

FIELD OF THE INVENTION

The present invention relates to a toy vehicle launcher and, in particular, to a toy vehicle launcher that may be efficiently loaded and deployed.

BACKGROUND OF THE INVENTION

Conventional toy vehicle track sets include one or more sections of track along which a toy vehicle may travel. In some track sets, accessories such as launchers will act on a toy vehicle to provide a force that moves the toy vehicle along the track. However, young children and other users may struggle with loading or actuating the launchers to generate the force necessary to propel a toy vehicle along the track or through various obstacles such as jumps and loops. Thus, there is a need for a toy vehicle launcher that is easy for users of all ages to operate while still providing a sufficient launching force on the toy vehicles. Furthermore, because children may grow tired of playing with the same accessories, accessories that provide new and interesting play features to a toy vehicle track set are continuously desired.

SUMMARY OF THE INVENTION

A toy vehicle launcher is presented herein. The toy vehicle launcher is a front-loaded, top-down, spring-loaded launcher configured to impart a launching force to a toy vehicle. The toy vehicle launcher is configured such that an individual such as a young child may readily load and launch a toy vehicle.

According to one example embodiment, a toy vehicle launcher assembly includes a housing and a launcher that is at least partially disposed in the housing. The launcher includes a load mechanism, an actuator mechanism, and a push mechanism. The load mechanism includes a first arm with a handle portion and a second arm with an engagement extension, the handle portion being configured to pivot along a first axis to move the engagement extension. A length of the first arm is also longer than a length of the second arm. The actuator mechanism includes a catch. The push mechanism includes a launching member having a first end for engaging with the catch and a second end opposite the first end for engaging a toy vehicle. Rotating the handle portion of the load mechanism towards the push mechanism causes the engagement extension to pull the launching member laterally towards the actuator mechanism.

According to another example embodiment, a toy vehicle launcher includes a load mechanism, a push mechanism, and an actuator mechanism. The push mechanism includes a launching member and a biasing member. The launching member has a receptacle with an inner lip and the load mechanism is configured to move the launching member along a first axis in only a first direction. The actuator mechanism includes an actuator button, a spring, and an engagement end having an angled edge. When the angled edge is disposed within the receptacle and engaged with the inner lip, the push mechanism is prepared to launch a toy vehicle along the first axis. When the actuator button is pressed while the angled edge is disposed within the receptacle and engaged with the inner lip, the spring is arranged to compress along a second axis to release the launching member and allow the biasing member to cause the launching member to move along the first axis in a second direction, the second direction being opposite from the first direction.

In accordance with still another example embodiment, a toy vehicle launcher assembly includes a housing, a base, and a launcher. The housing is coupled to the base, and the launcher is at least partially disposed in the housing and atop the base. The launcher includes a load mechanism, an actuator mechanism, and a push mechanism. The load mechanism includes a rotational component, the rotational component having a handle portion and an engagement extension. The actuator mechanism includes an engagement end with a protrusion disposed thereon. The push mechanism includes a launching member having a receptacle with an inner lip and a biasing member coupled to the launching member and the housing. The load mechanism is configured to move the launching member in a first direction along an x-axis such that the engagement end of the actuator mechanism is inserted into the receptacle of the launching member and the protrusion engages the inner lip. The actuator mechanism is configured to disengage the protrusion from the inner lip when a force is applied to the actuator mechanism in a second direction along a z-axis, thereby allowing the biasing member to impart a launching force on the launching member in a third direction along the x-axis, the third direction being opposite of the first direction.

BRIEF DESCRIPTION OF THE DRAWINGS

FIG. 1A is a first perspective view of the toy vehicle launcher. FIG. 1B is a second perspective view of the toy vehicle launcher. FIG. 1C is a first side view of the toy vehicle launcher. FIG. 1D is a second side view of the toy vehicle launcher. FIG. 1E is a front view of the toy vehicle launcher. FIG. 1F is a back view of the toy vehicle launcher. FIG. 1G is a top view of the toy vehicle launcher. FIG. 1H is a bottom view of the toy vehicle launcher.

FIG. 2A is a cross-sectional perspective view of the toy vehicle launcher. FIG. 2B is a cross-sectional side view of the toy vehicle launcher with springs included.

FIG. 3A shows the toy vehicle launcher in a default configuration with a launching member in a default position. FIG. 3B shows the toy vehicle launcher moving from the default configuration to a loaded configuration as the launching member is moved from the default position to a loaded position. FIG. 3C shows the toy vehicle launcher as the launching member is released from the loaded position to provide a launching force. FIG. 3D shows the toy vehicle launcher returning to the default configuration after the launching member has returned to the default position.

Like reference numerals have been used to identify like elements throughout this disclosure.

DETAILED DESCRIPTION OF THE INVENTION

Figure 1A:
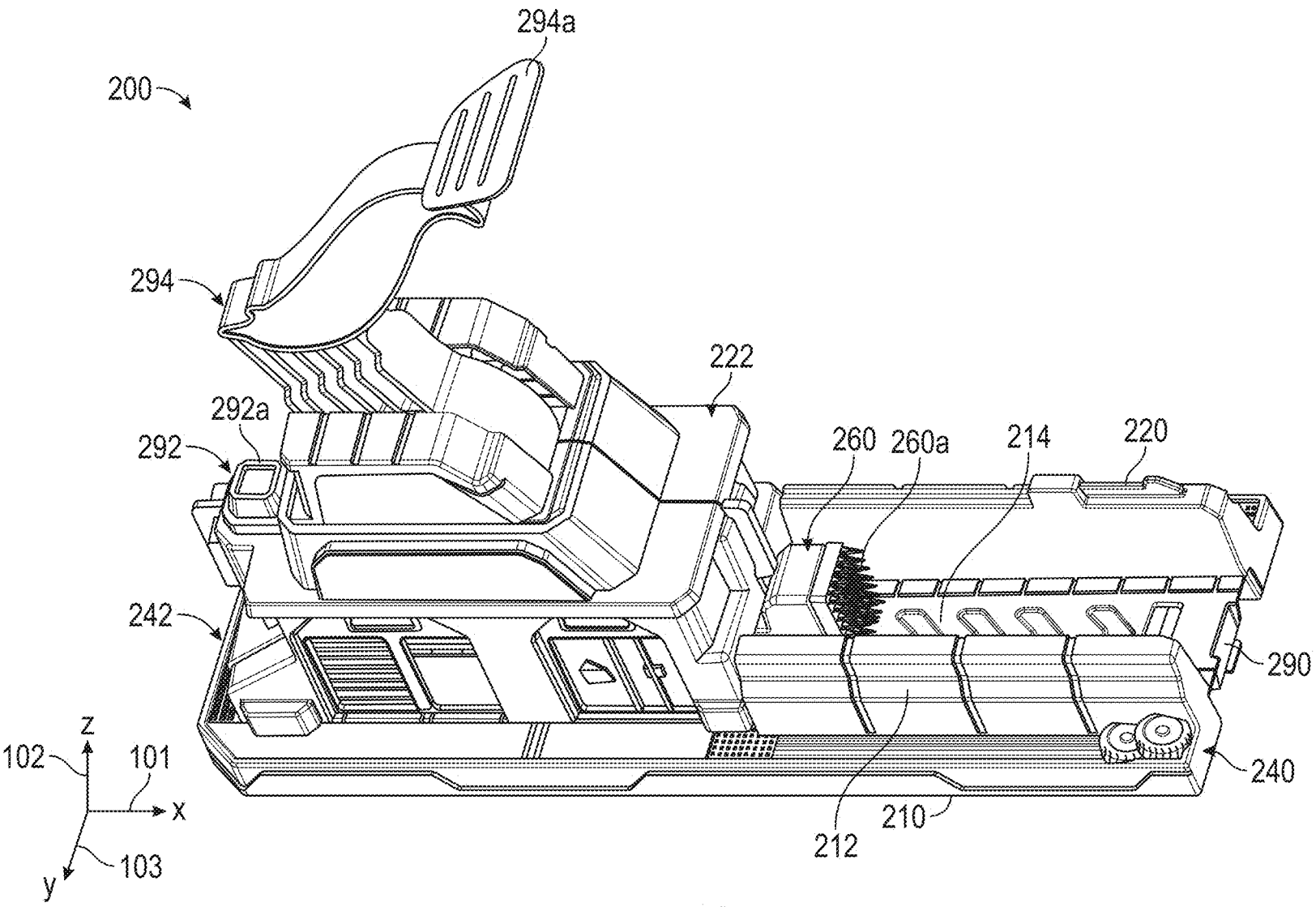
FIGS. 1A-1H illustrate a toy vehicle launcher formed in accordance with an embodiment of the present application.
Figure 1B:
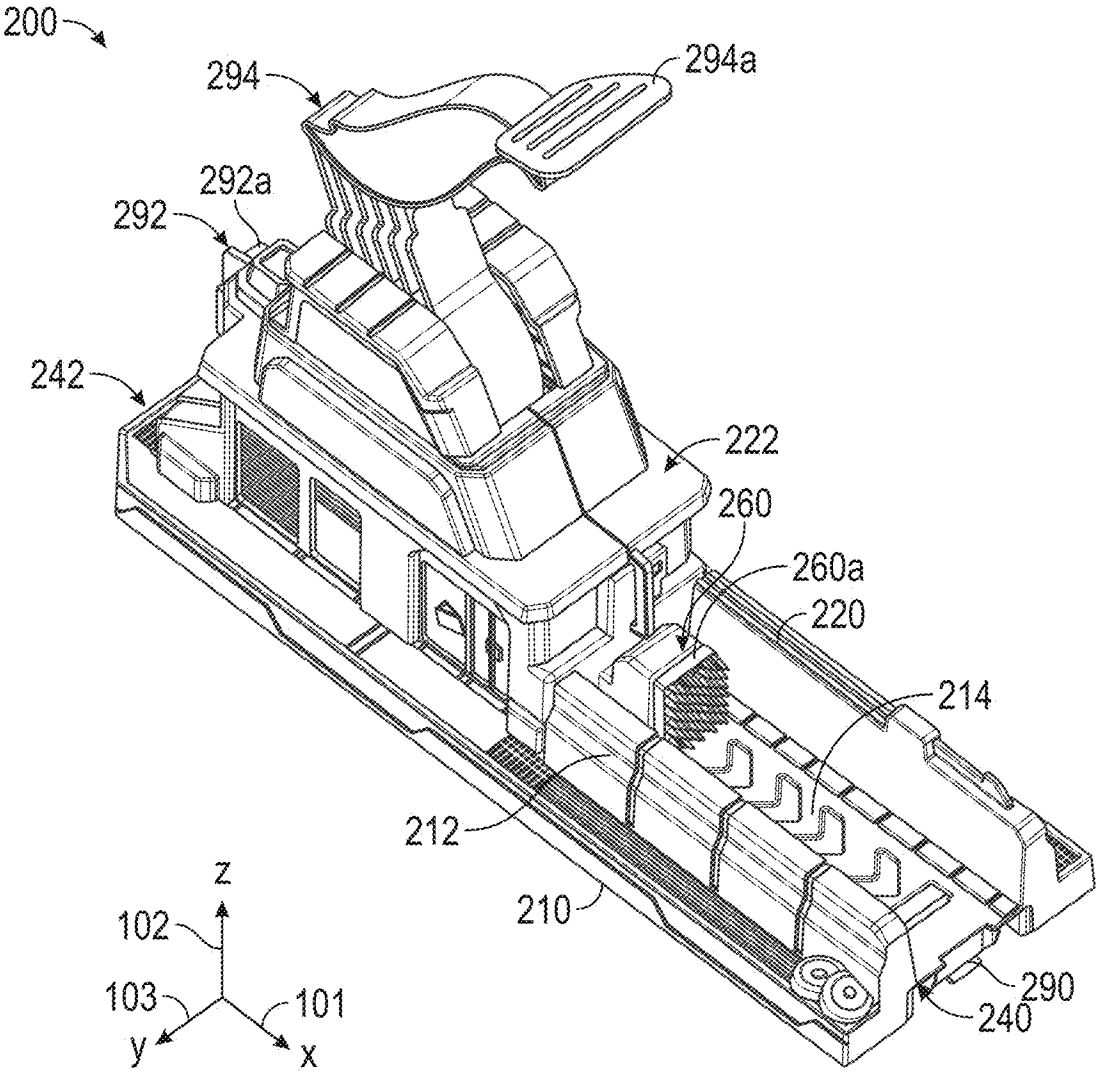
Figure 1C:
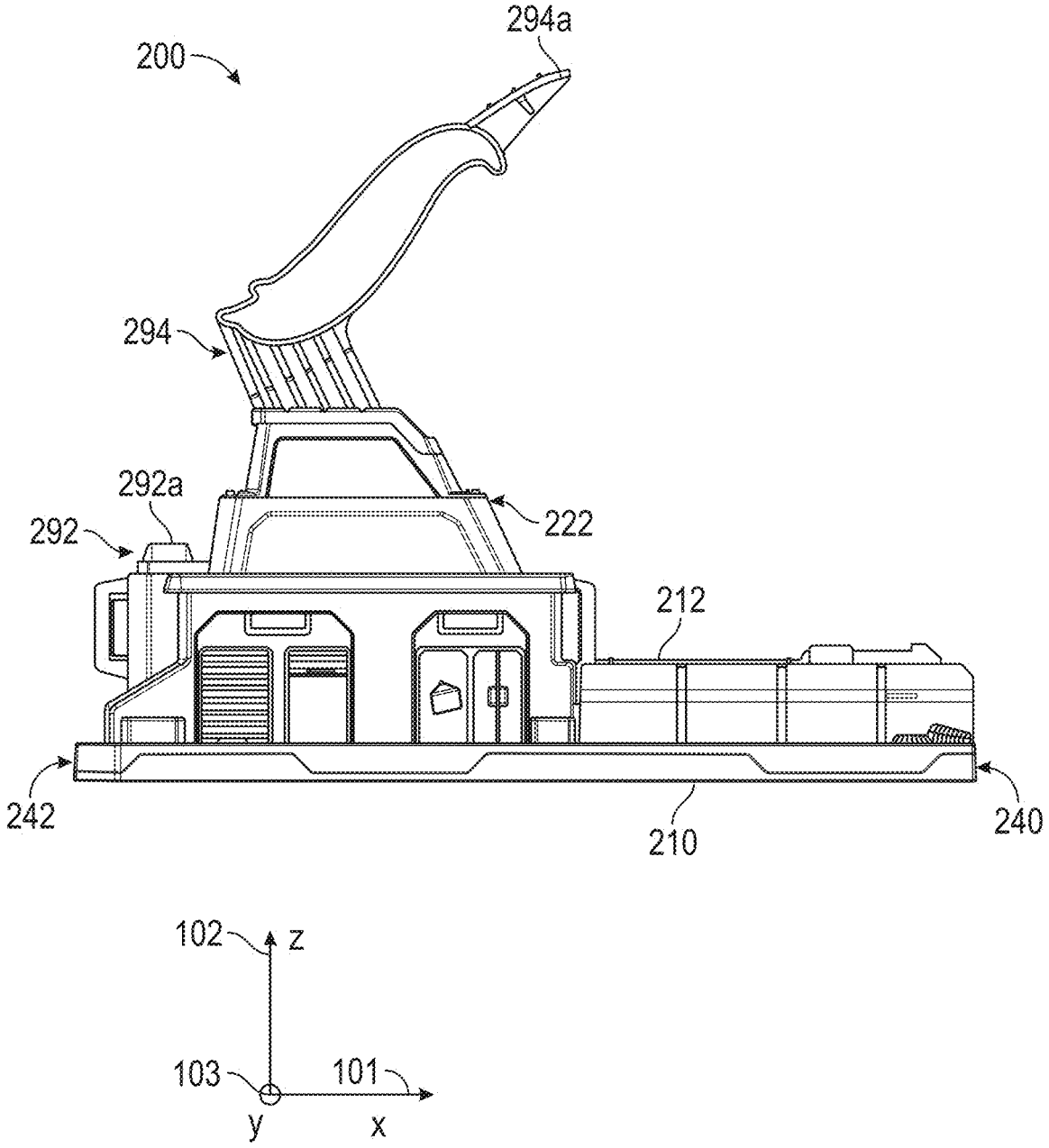
Figure 1D:
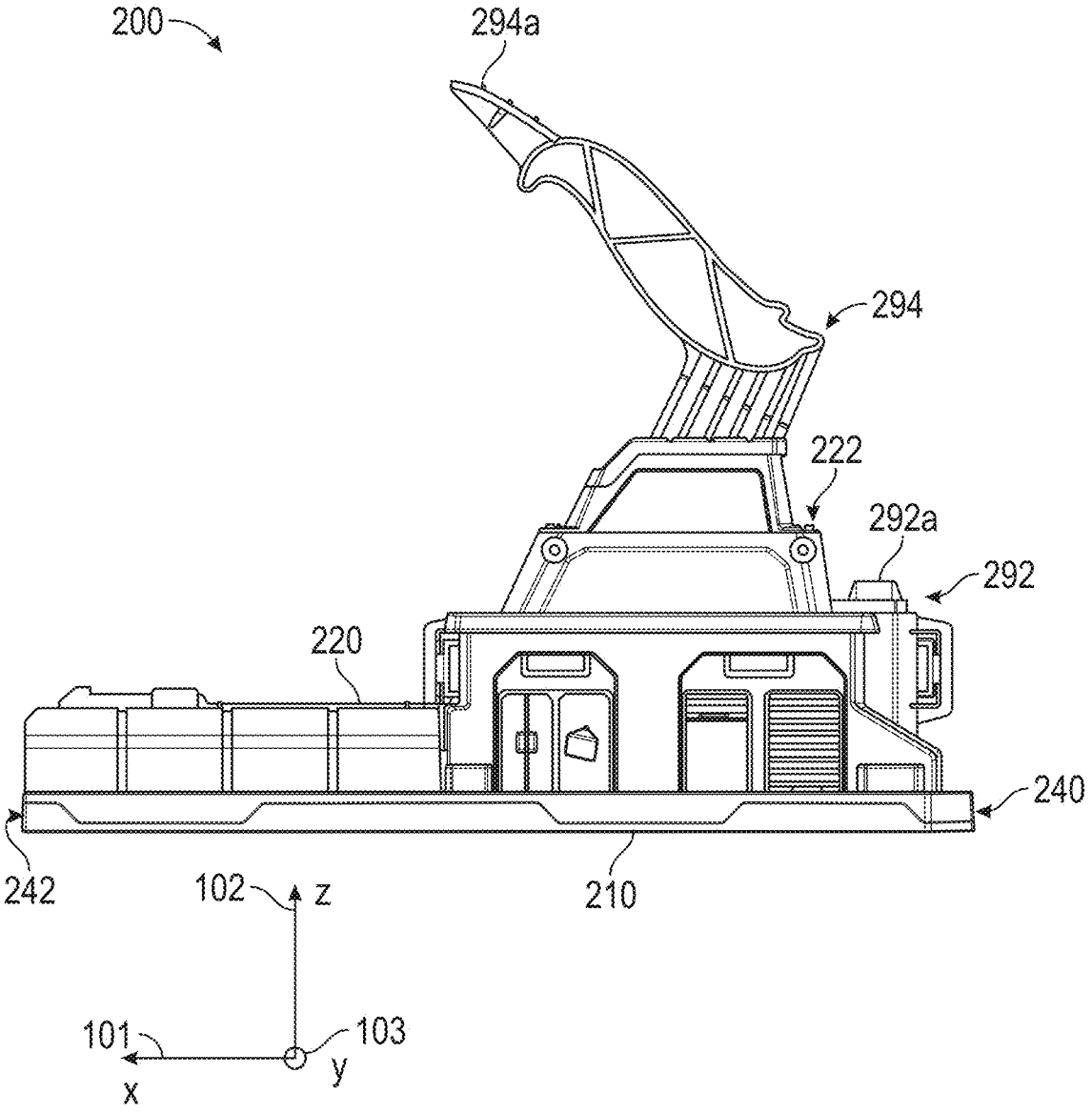
Figure 1E:
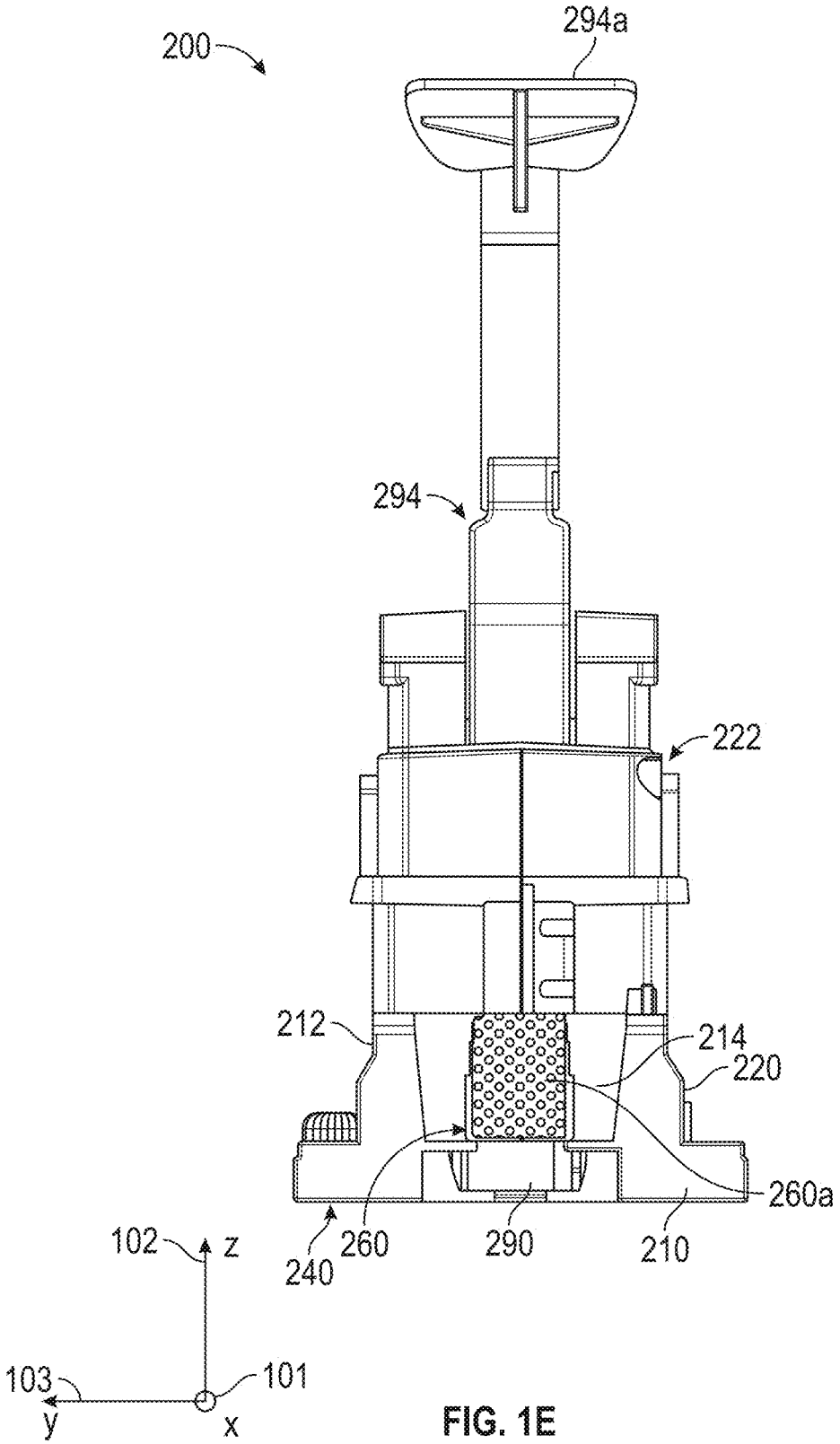
Figure 1F:
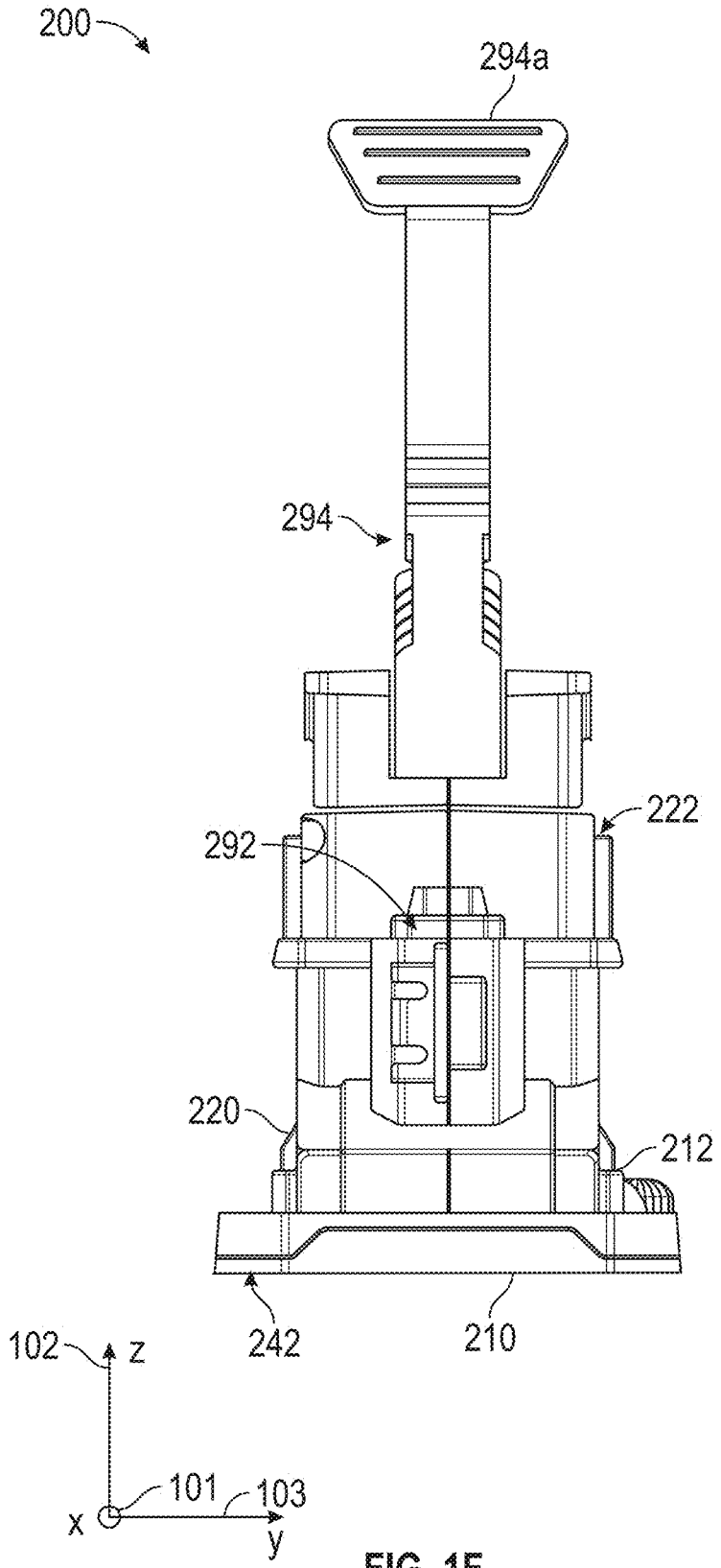
Figure 1G:
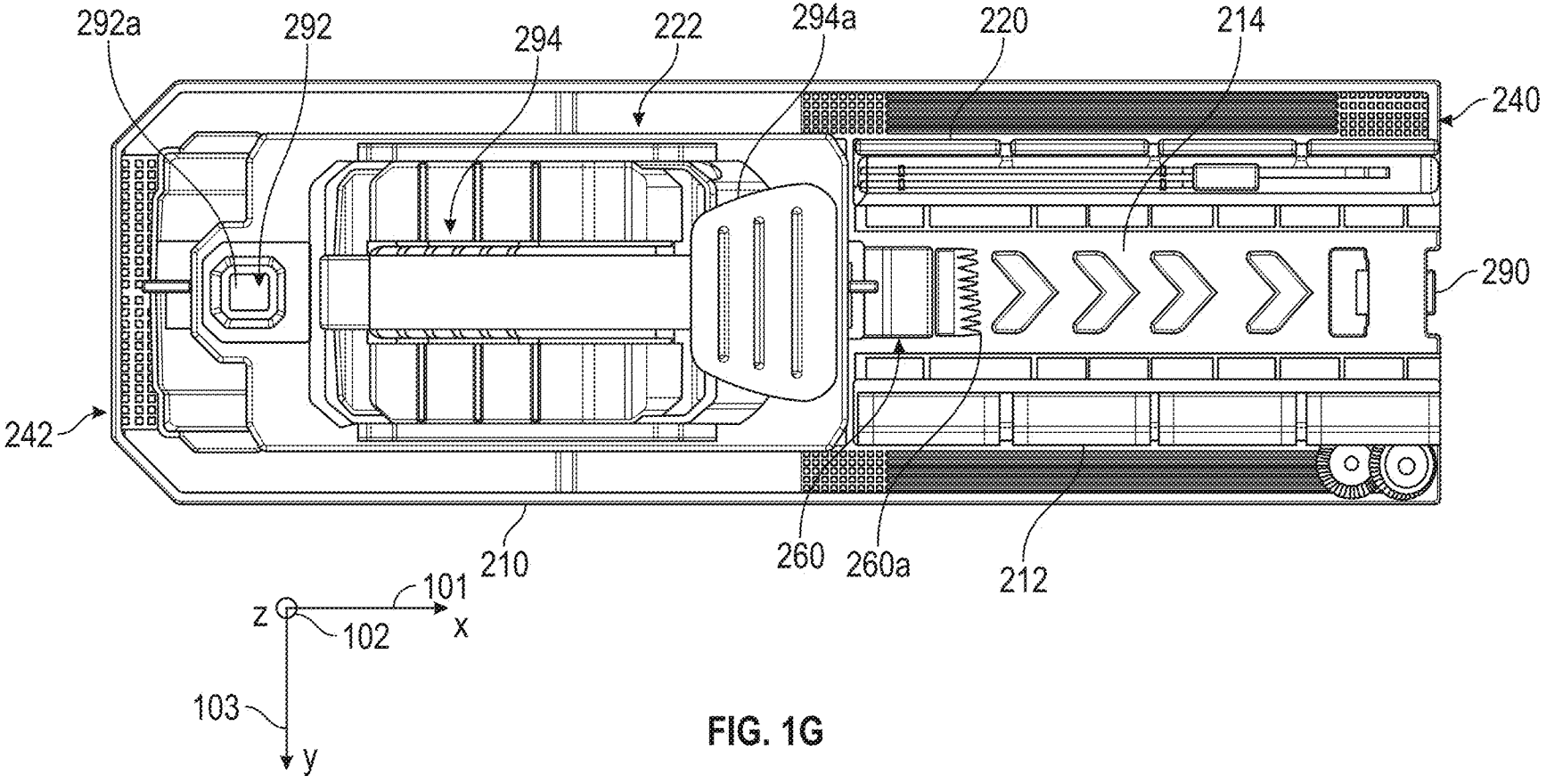
Figure 1H:
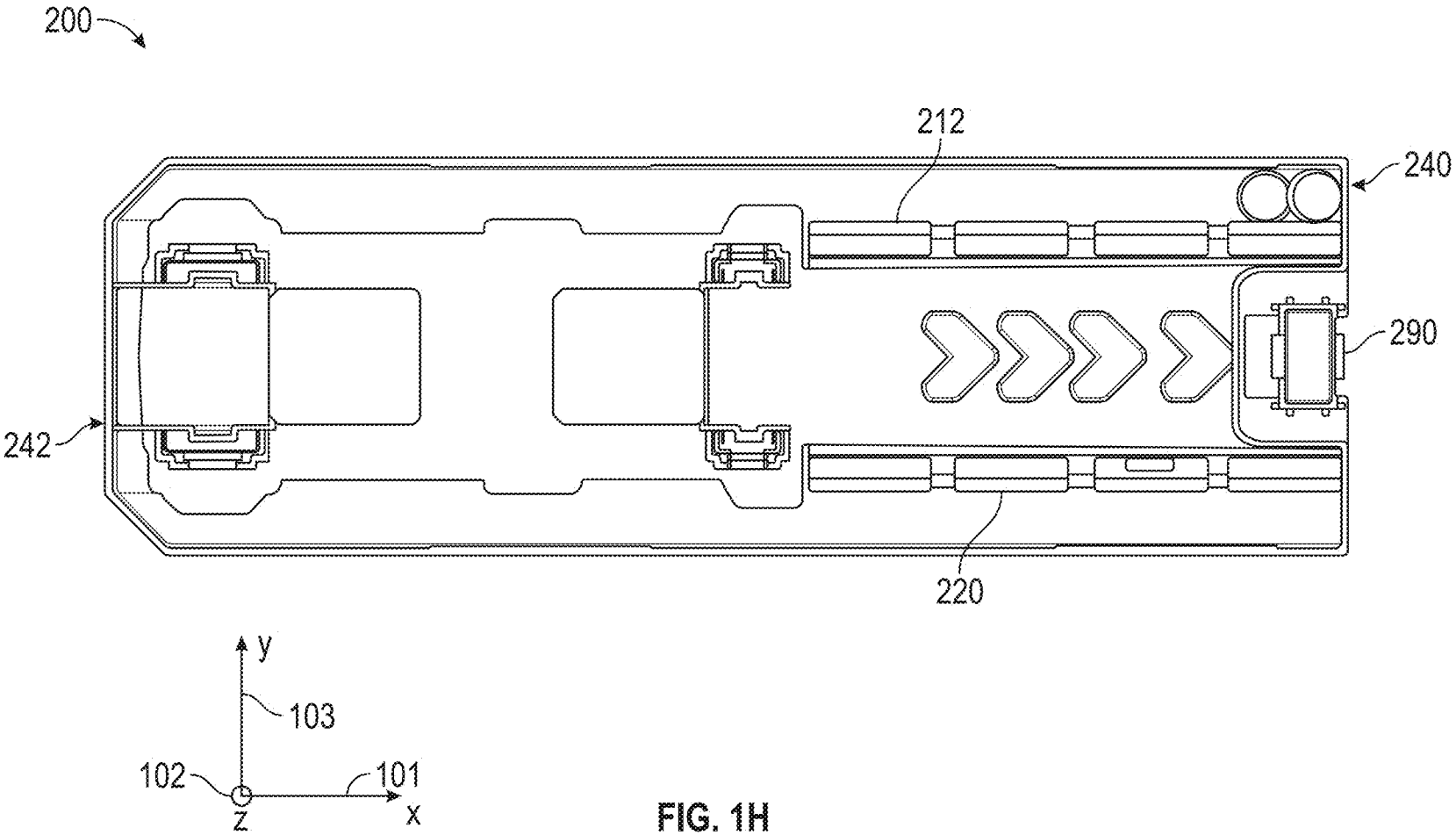

Overall, a toy vehicle launcher is presented herein. A user may manually actuate the toy vehicle launcher. More generally, the toy vehicle launcher may be manually prepared to launch a toy vehicle, as well as actually launch a toy vehicle, by a user. As children often play with toy vehicles, the ability for a toy vehicle launcher to be readily used by a child enables the child to utilize the vehicle launcher substantially without assistance from an adult. Thus, the play value of the toy vehicle launcher may be enhanced.

FIGS. 1A-1H and FIGS. 2A-2B illustrate an example embodiment of the toy vehicle launcher presented herein. As shown, an overall launcher assembly 200 is in a "ready-to-launch" or "loaded" configuration, and is in a state in which overall launcher assembly 200 is prepared to launch a toy vehicle (not shown). In this example embodiment, the overall launcher assembly 200 includes features that allow it to be included or incorporated into a toy vehicle track set. In particular, the overall launcher assembly 200 includes a mechanical coupler 290 that may connect overall launcher assembly 200 to other track pieces that may also include one or more couplers similar or complementary to coupler 290. In one embodiment, coupler 290 is a tile or playset connection, although it should be appreciated that the configuration of coupler 290 may vary widely. As shown, coupler 290 is positioned at a front end 240 of overall launcher assembly 200. It should be appreciated that although no coupler is located at a back end 242 of overall launcher assembly 200, overall launcher assembly 200 is not limited to including only one coupler 290 to enable overall launcher assembly 200 to be incorporated into a toy vehicle track set. Overall launcher assembly 200 is merely one example of the toy vehicle launcher presented herein and, in other embodiments, the toy vehicle launcher presented herein need not include features that allow it to be included or incorporated into a track set.

Overall launcher assembly 200 includes a base portion 210 that defines and/or supports a cavity 214, an actuator mechanism 292, a load mechanism 294, a push mechanism 260, and a launcher housing 222, among other features. More specifically, base portion 210 is coupled to and/or integrally formed with a first wall 212 and a second wall 220 that substantially cooperate to define cavity 214 (also referred to as a track pathway) through which a toy vehicle may travel after being pushed, or otherwise launched, by push mechanism 260. First wall 212 and second wall 220 cooperate to ensure that a toy vehicle launched by push mechanism 260 generally maintains a direction along an x-axis 101 on base portion 210.

As will be discussed in more detail below, load mechanism 294 is used to prepare push mechanism 260 to launch a toy vehicle and engage actuator mechanism 292. Launcher housing 222 is coupled to base portion 210 such that portions of actuator mechanism 292, load mechanism 294, and push mechanism 260 are at least partially disposed within housing 222, and substantially atop base portion 210. Launcher housing 222 is arranged to protect portions of actuator mechanism 292, load mechanism 294, and push mechanism 260 and also prevents a user from touching the internal components. In the embodiment shown, launcher housing 222 is stylized to resemble a building, although it should be appreciated that the configuration of launcher housing 222 is not limited to this style and may vary widely.

Overall launcher assembly 200 generally involves a top-down lever launcher that is arranged to enable the propulsion of a front-loaded toy vehicle. The configuration of load mechanism 294, push mechanism 260, and actuator mechanism 292 are such that loading overall launcher assembly 200, or weighting and/or leveraging overall launcher assembly 200, may be readily accomplished by an individual such as a young child. In other words, overall launcher assembly 200 may be prepared to launch a toy vehicle as well to actually launch the toy vehicle by an individual with the strength and the dexterity of a young child. In one embodiment, load mechanism 294, push mechanism 260, and actuator mechanism effectively form the launcher.

Figure 2A:
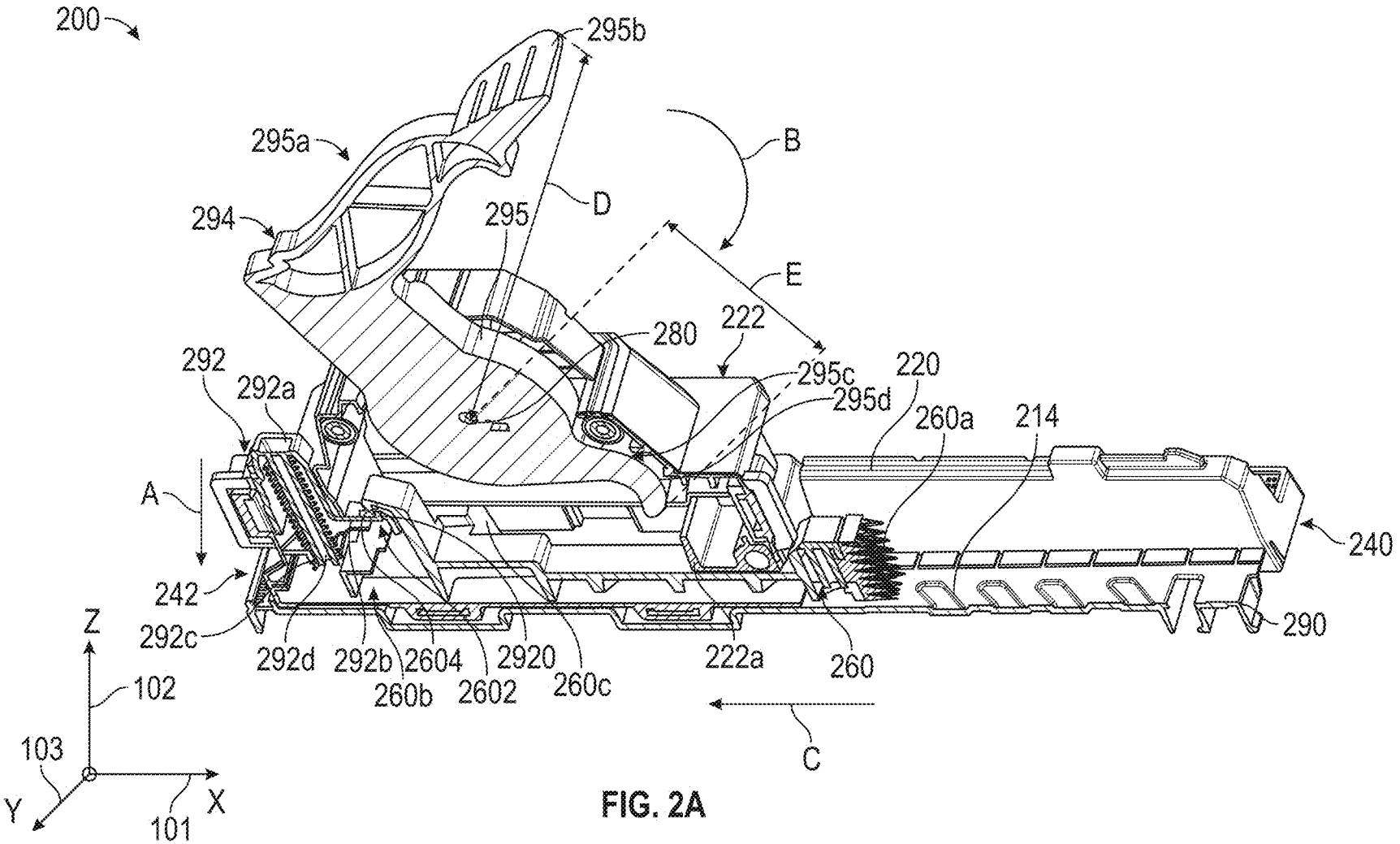
FIGS. 2A-2B illustrate cross-sectional views of the toy vehicle launcher of FIGS. 1A-1H in accordance with an embodiment of the present application.
Figure 2B:
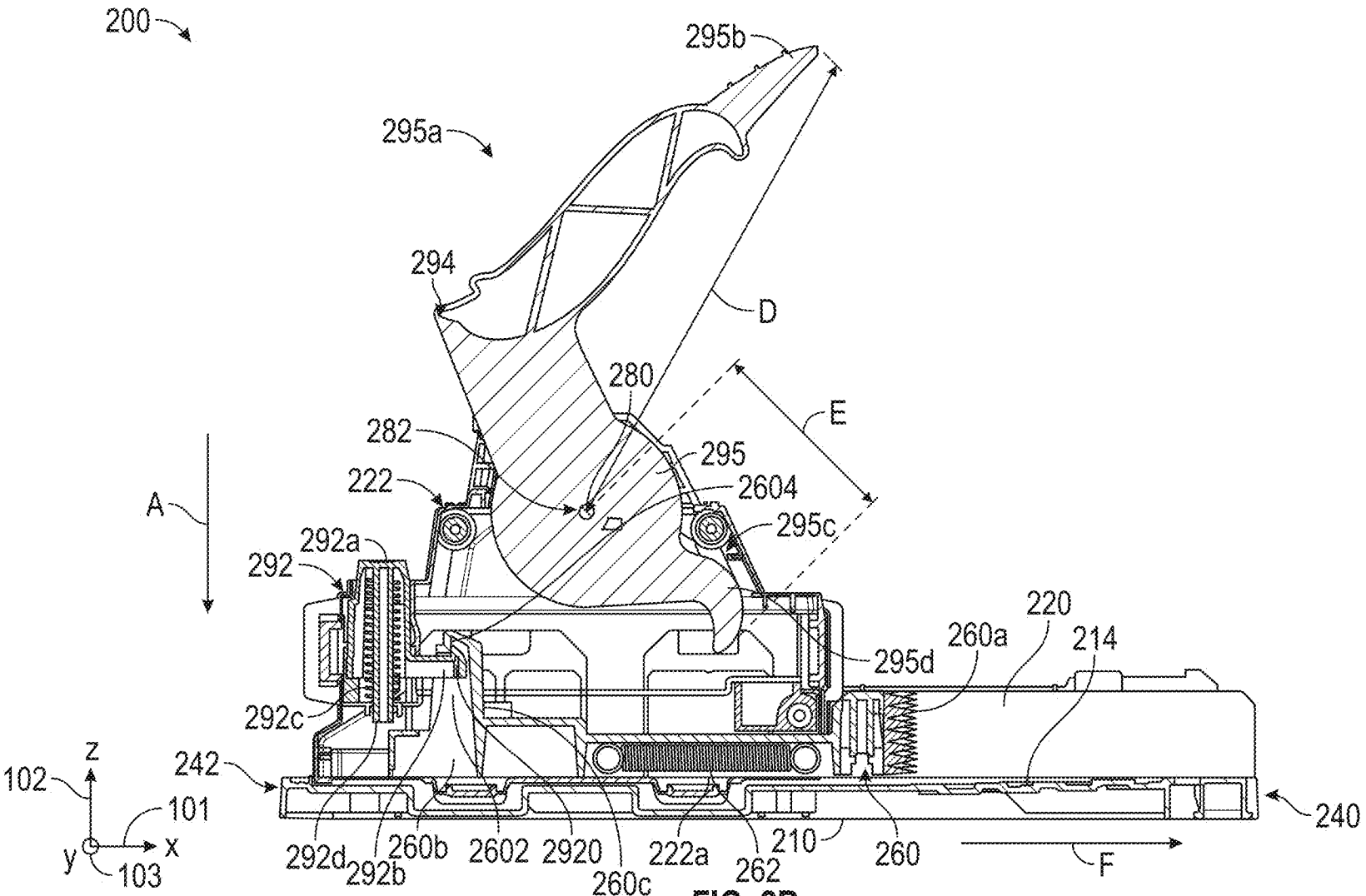

As can be seen in FIGS. 2A and 2B, actuator mechanism 292, or an actuator portion of overall launcher assembly 200, includes an actuator button 292*a*, an engagement end 292*b* with a protrusion or angled edge 2920 (which is also referred to herein as a "catch"), a resilient element such as a spring 292*c*, and a rod 292*d* around which resilient element 292*c* is coiled or otherwise positioned. Actuator button 292*a* is arranged to be pressed, e.g., moved in a downwards direction "A" relative to a z-axis 102, to cause resilient element 292*c* to compress or to be in a compressed state. In other words, when actuator button 292*a* is pressed, actuator button 292*a* applies a force to resilient element 292*c* to compress resilient element 292*c*. When actuator button 292*a* is no longer pressed, resilient element 292*c* decompresses and returns to its original state.

Load mechanism 294 includes a rotational component 295 having a loading arm 295*a* with a handle portion 295*b* and an engagement arm 295*c* with an engagement extension 295*d*. Loading arm 295*a* and handle portion 295*b* are arranged to be used, e.g., by a young child, to cause rotational component 295 to rotate around a pin 280 or fulcrum with a rotational axis aligned with a y-axis 103. Pin 280 is coupled to housing 222 such that rotational component 295, a torsion spring 282, and more generally, load mechanism 294 are supported by housing 222. As rotational component 295 rotates in a clockwise direction "B", engagement extension 295*d* of engagement arm 295*c* causes push mechanism 260 to move in a direction "C" along the x-axis 101 towards actuator mechanism 292 or back end 242, with push mechanism 260 being ultimately weighted or loaded to launch a toy vehicle once push mechanism 260 is fully engaged with actuator mechanism 292.

Rotational component 295 effectively functions as a lever with its fulcrum or pivot point at pin 280. Loading arm 295*a* and engagement arm 295*c* are different lengths, with handle portion 295*b* being a distance "D" from pin 280 and the end of engagement extension 295*d* being a distance "E" from pin 280. More specifically, distance "D" of loading arm 295*a* is preferably longer than distance "E" of engagement arm 295*c* to provide leverage that allows a user, e.g., a young child, to easily load launcher assembly 200. In certain embodiments, distance "D" is more than two times distance "E". Furthermore, loading arm 295*a* may be angled, curved, or bent as shown in FIG. 2B. This configuration of the loading arm 295*a* utilizes the force of gravity to help with the rotation of rotational component 295 and further reduces the input force or effort needed to load launcher assembly 200 as a user pushes substantially downwards (i.e., direction "A") on handle portion 295*b*.

When the input force on load mechanism 294 is removed (e.g., when a young child takes his hand off of handle portion 294*a*), a torsion spring 282 coupled to rotational component 295 is biased to cause rotational component 295 to rotate in a counter-clockwise direction (i.e., opposite of direction "B") and return load mechanism 294 to its original position. Moreover, load mechanism 294 does not further cause push mechanism 260 to move as rotational component 295 returns to its original position (i.e., push mechanism 260 stays engaged with actuator mechanism 292 in a loaded configuration). By returning to its original position, engagement extension 295*d* is moved out of the way for push mechanism 260 to launch a toy vehicle in a direction "F" along the x-axis 101.

Push mechanism 260 includes an elongated launching member 260*b* with a contact end 260*a* or contact pad, one or more stop members 260*c*, and a biasing member such as a spring 262 or a rubber band coupling launching member 260*b* to launcher housing 222. In general, launching member 260*b* is configured to slide laterally along base portion 210 when moving between a default position and a loaded position. Contact end 260*a* includes a surface that is configured to contact a toy vehicle (more specifically, the rear end of a toy vehicle) to push or launch the toy vehicle. Contact end 260*a* may be configured to include an array of protrusions, for example flexible conical protrusions or bristles made of a rubber-like material as shown in FIG. 2B. The array of flexible protrusions on contact end 260*a* allows the push mechanism 260 to accommodate and effectively propel toy vehicles that may have differently shaped or angled rear ends. In contrast to a simple flat surface, the array of flexible protrusions conforms to the profile of the rear end of a toy vehicle as the push mechanism launches the toy vehicle. This allows the push mechanism to impart a launching force to a greater portion of the rear end and also helps prevent the toy vehicle from flying off of the track pathway. It should also be appreciated that contact end 260*a* is not limited to an array of protrusions and may be of other materials, shapes, or designs, such as an array of triangular prisms.

Launching member 260*b* includes a receptacle space 2602 that is arranged to accommodate engagement end 292*b* of actuator mechanism 292 when launching member 260*b* is engaged with or otherwise interfaced with actuator mechanism 292 while in the loaded position (i.e., ready to launch a vehicle). In one embodiment, the catch or angled edge 2920 is substantially retained within receptacle space 2602 by a raised lip 2604 or protrusion of launching member 260*b*. Pressing on the actuator button 292*a* of the actuator mechanism 292 causes the catch or angled edge 2920 to disengage from lip 2604 and allow spring 262 to pull launching member 260*b* back towards the front end 240 (i.e., away from actuator mechanism 292).

In more detail, when an input force is applied to handle portion 295*b* to cause rotational component 295 to rotate in the clockwise direction "B", engagement extension 295*d* pulls launching member 260*b* towards the back end 242 and stretches spring 262. As the input force is continually applied to handle portion 294*a*, launching member 260*b* eventually presses against engagement end 292*b*, and angled edge 2920 is substantially inserted or forced into and retained within receptacle space 2602 by lip 2604. It should be appreciated that when launching member 260*b* is pressed against engagement end 292*b*, resilient element 292*c* may be compressed to allow angled edge 2920 to essentially pass under lip 2604 while entering receptacle space 2602. Once angled edge 2920 is positioned within receptacle space 2602, resilient element 292*c* is typically no longer in a compressed state, i.e., resilient element 292*c* returns to its default position when resilient element 292*c* is no longer under significant compression.

When angled edge 2920 is positioned within receptacle space 2602 and engaged with lip 2604, overall launcher assembly 200 is effectively weighted and prepared to launch a toy vehicle (not shown) positioned in cavity 214 (i.e., "ready-to-launch" or loaded configuration). In one embodiment, while angled edge 2920 is effectively captured within receptacle space 2602 and retained by lip 2604, pressing or applying a force on actuator button 292*a* compresses resilient element 292*c* and disengages angled edge 2920 from lip 2604. Once angled edge 2920 is disengaged from lip 2604, stretched spring 262 is then able to pull launching member 260*b* back towards the front end 240 along the x-axis 101 as it returns to its original shape, thereby imparting a propulsion or launch force to push mechanism 260. It should be appreciated that the magnitude of the launch force may vary widely based on factors including, but not limited to, the size, material, and/or stiffness of spring 262, and/or the size or weight of push mechanism 260.

Launching member 260*b* is further constrained to move within housing 222 by one or more stop members 260*c* attached to or formed as part of launching member 206*b*. By way of example, as launching member 260*b* moves or translates in direction "F" along the x-axis 101 away from actuator mechanism 292, stop member 260*c* will eventually contact a stop pad 222*a* of housing 222 which substantially acts to stop the further movement of push mechanism 260. That is, when stop member 260*c* is effectively forced against stop pad 222*a*, contact end 260*a* is prevented from traveling past front end 240 along the x-axis 101. Stop pad 222*a* and/or stop member 260*c* may include or be made of a resilient material, such as rubber, that can absorb or reduce the noise generated when stop member 260*c* impacts stop pad 222*a*. Moreover, stop member 260*c* and stop pad 222*a* help protect the launcher housing 222 and load mechanism 294 from the repeated impact of push mechanism 260 as launching member 260*b* moves at a high speed within launcher housing 222 to effectively propel a toy vehicle.

Referring next to FIGS. 3A-3D, the movement of components in a toy vehicle launcher will be described in accordance with an embodiment. Launcher 300 is depicted, and is shown without some components of an overall launcher assembly for purposes of illustrating how a push mechanism 360, an actuator mechanism 392, and a load mechanism 394 operate or otherwise move. Launcher 300 is shown without components of an overall launcher assembly including a base, walls, springs, and one section of a housing 322, although it should be appreciated that an overall launcher assembly typically includes such components as described above with respect to overall launcher assembly 200 of FIGS. 1A-H and 2A-B.

Figure 3A:
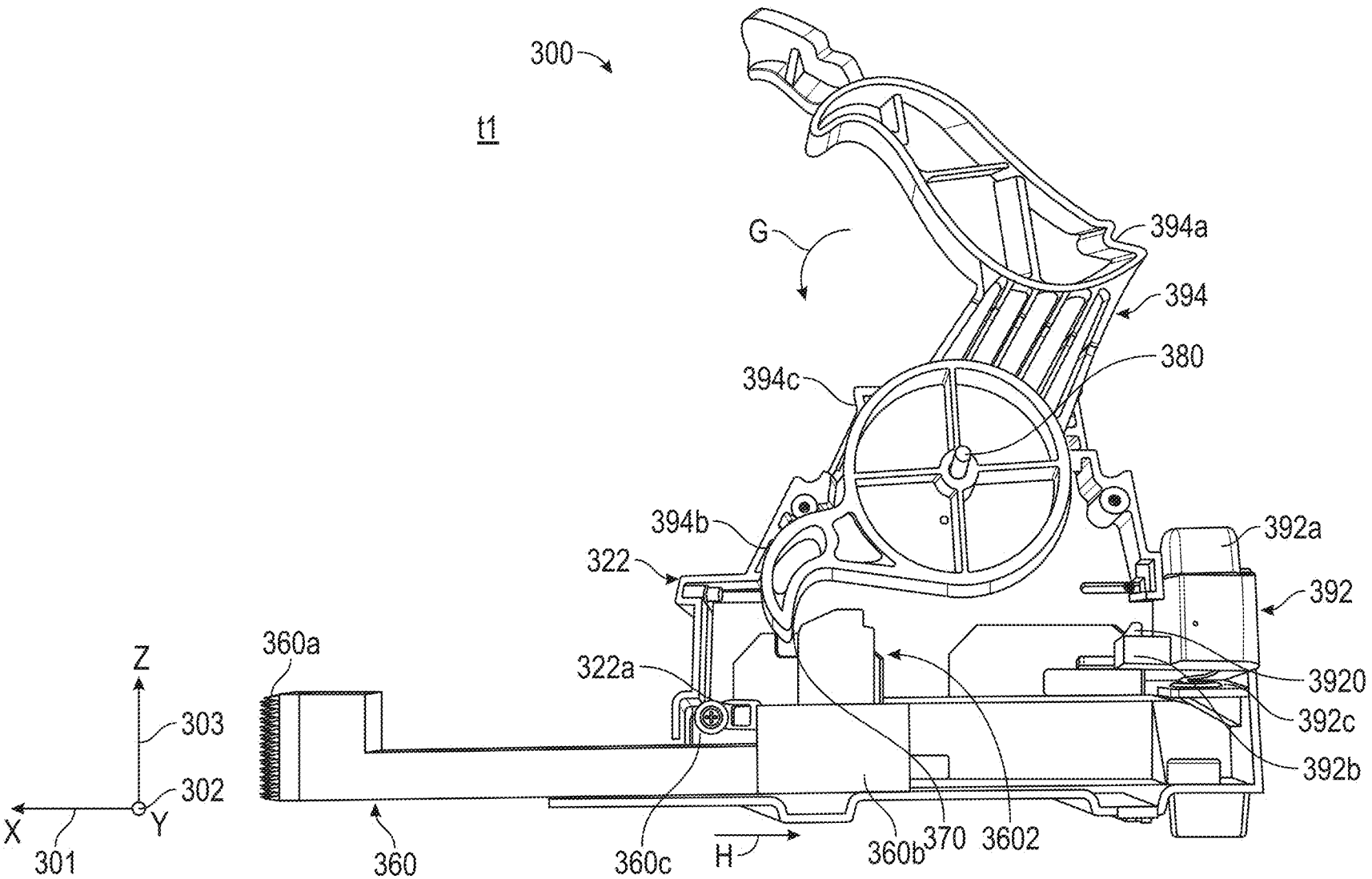
FIGS. 3A-3D illustrate a toy vehicle launcher with certain components (e.g., covers, supports, and housings) removed to show a loading and launching mechanism in action in accordance with another embodiment of the present application.

FIG. 3A shows a launcher 300 in a default configuration with a launching member 360*b* in a default position at a time t1. A handle portion 394*a* of load mechanism 394 may be manually moved with a downward force such that a rotational component 394*c* of load mechanism 394 rotates in a counter-clockwise direction "G" about a pin 380 or an axial component that is coupled to housing 322 and generally aligned with respect to a y-axis 302. As rotational component 394*c* rotates about pin 380, an engagement extension 394*b* of load mechanism 394 contacts launching member 360*b* of push mechanism 360 and causes launching member 360*b* to move along an x-axis 301 in a direction "H" towards an engagement end 392*b* of actuator mechanism 392. At time t1, engagement extension 394*b* contacts a receptacle 3602 of launching member 360*b* at a point 370.

Figure 3B:
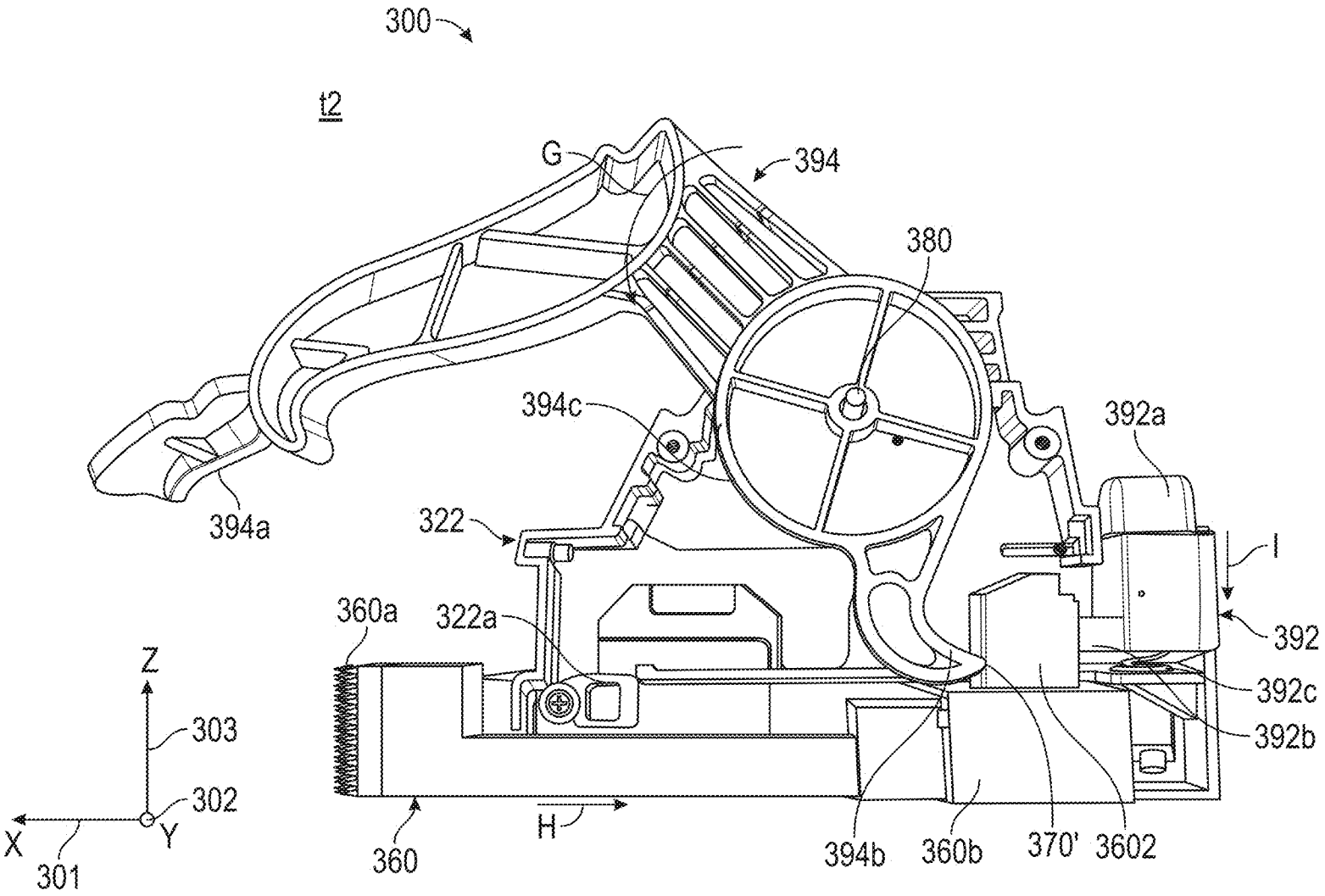

FIG. 3B shows launching member 306*b* of launcher 300 being moved to a loaded position at a time t2. Movement of load mechanism 394 causes engagement extension 394*b* to move launching member 360*b* in direction "H" until launching member 360*b* engages with an engagement end 392*b* of the actuator mechanism 392. More specifically, an angled edge 3920 of engagement end 392*b* (see FIG. 3A) engages and is retained by a lip or hooked portion inside receptacle 3602. Notably, when angled edge 3920 is engaged with the lip inside receptacle 3602 of launching member 360*b*, engagement extension 394*b* contacts receptacle 3602 of launching member 360*b* at a point 370'. As rotational component 394*c* rotates about pin 380 to cause engagement extension 394*b* to move launching member 360*b*, engagement extension 394*b* slides down a surface or side of receptacle 3602 along the z-axis 303 in a direction "I" while simultaneously moving launching member 360*b* along the x-axis 101 in direction "H" towards actuator mechanism 392.

A resilient element 392*c* of actuator mechanism 392 may be compressed along the z-axis 303 in direction "I" as angled edge 3920 of engagement end 392*b* comes into contact with the lip inside receptacle 3602 of launching member 360*b*, and decompressed thereafter to enable the angled edge 3920 to effectively lock or restrain launching member 360*b*. In one embodiment, resilient element 392*c* is a spring. The compression of resilient element 392*c* may be triggered when angled edge 3920 is forced against launching member 360*b* and into receptacle 3602 by a force applied by engagement extension 394*b* along the x-axis 301. At time t2, resilient element 392*c* is in a state, e.g., a decompressed state, such that engagement end 392*b*, with angled edge 3920 disposed thereon, is locked with launching member 360*b*.

Figure 3C:
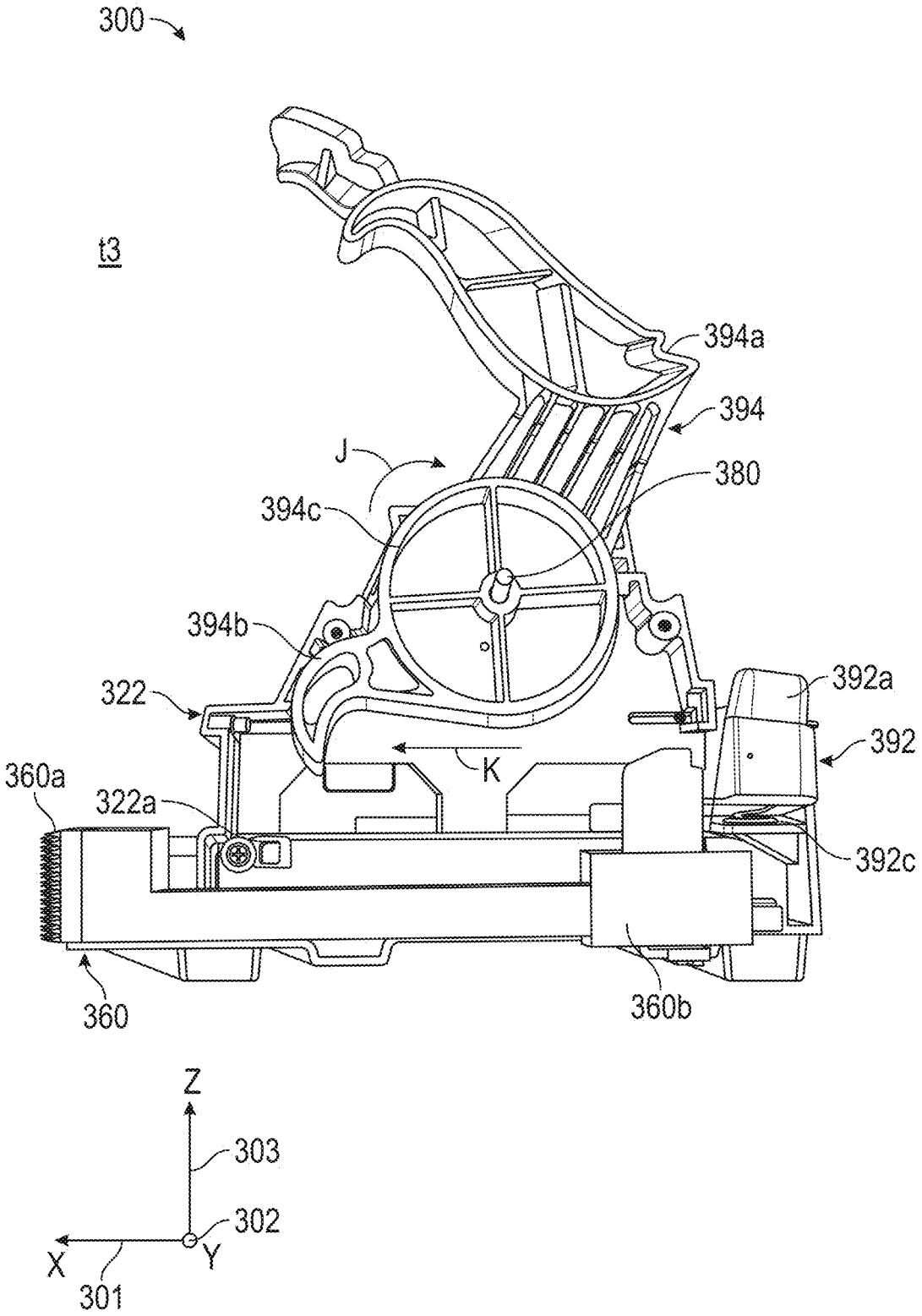

FIG. 3C shows launching member 360*b* of launcher 300 being released from the loaded position at a time t3. An actuator button 392*a* of actuator mechanism 392 is pressed to activate push mechanism 360 and launch a toy vehicle. As shown, the force pushing down on handle portion 394*a* of load mechanism 394 has been removed. Subsequently, a torsion spring (not shown) causes the rotational component 394*c* to rotate in a clockwise direction "J" such that engagement extension 394*b* no longer abuts launching member 360*b*. However, it should also be appreciated that in other embodiments, launching member 360*b* may remain in contact with engagement extension 394*b* and may subsequently cause rotational component 394*c* to rotate in clockwise direction "J" as launching member 360*b* pushes engagement extension 394*b* while moving in a direction "K" to return to its default position.

When actuator button 392*a* is pressed, resilient element 392*c* is compressed. Actuator button 392*a* is pressed such that a force is applied to actuator button 392*a* generally along the z-axis 303. The compression of resilient element 392*c* is also relative to the z-axis 303. Causing resilient element 392*c* to be in a compressed state enables angled edge 3920 of engagement end 292*b* to become disengaged from launching member 360*b*. When the angled edge is disengaged, a spring or other biasing member (not shown) coupled to launching member 360*b* and housing 322 causes launching member 360*b* to move along the x-axis 301 in the direction "K" away from actuator mechanism 392, which applies or imparts a launching force to launching member 360*b*. When a toy vehicle is positioned against contact end 360*a*, the toy vehicle may then be propelled by push mechanism 360.

Figure 3D:
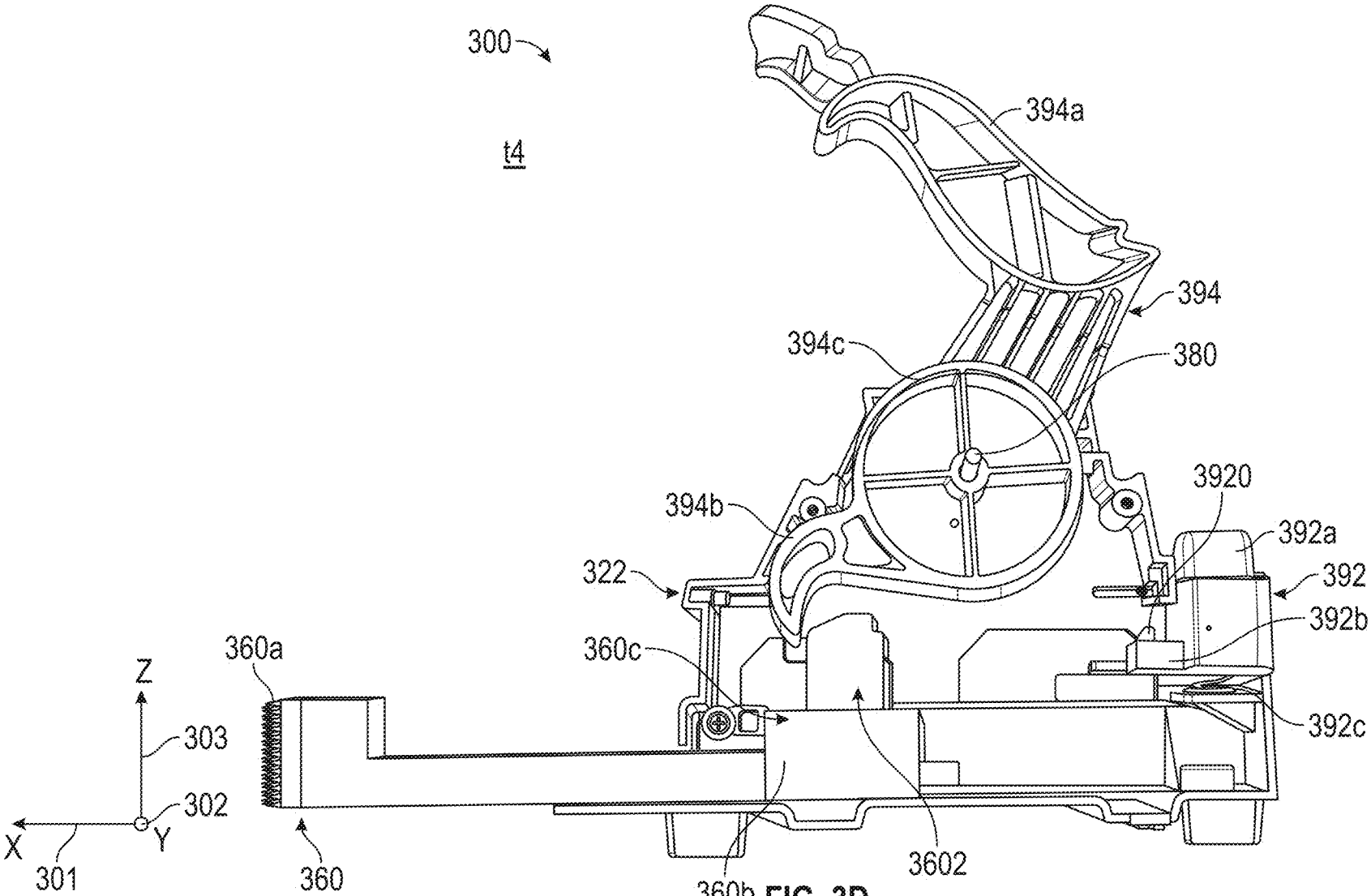

FIG. 3D shows launching member 360*b* of launcher 300 having returned to the default position at a time t4. Push mechanism 360 is fully launched, with a stop member (similar to the stop member 360*c* shown in FIG. 3D, but positioned on the opposite side of launching member 360*b*) of push mechanism 360 contacting a stop pad 322*a* (see FIG. 3C) of housing 322 and preventing further movement of launching member 360*b* relative to the x-axis 301. Stop pad 322*a* is arranged to stop the movement of push mechanism 360 as launching member 360*b* travels along the x-axis 301 away from actuator mechanism 392. In general, the stop members may be substantially forced against stop pad 322*a* to constrain the movement of push mechanism 360 such that at least a portion of launching member 360*b* remains within housing 322. In one embodiment, when the stop member is in contact with stop pad 322*a*, engagement extension 394*b* comes back into contact with receptacle 3602 of launching member 360*b*.

Figure 4:
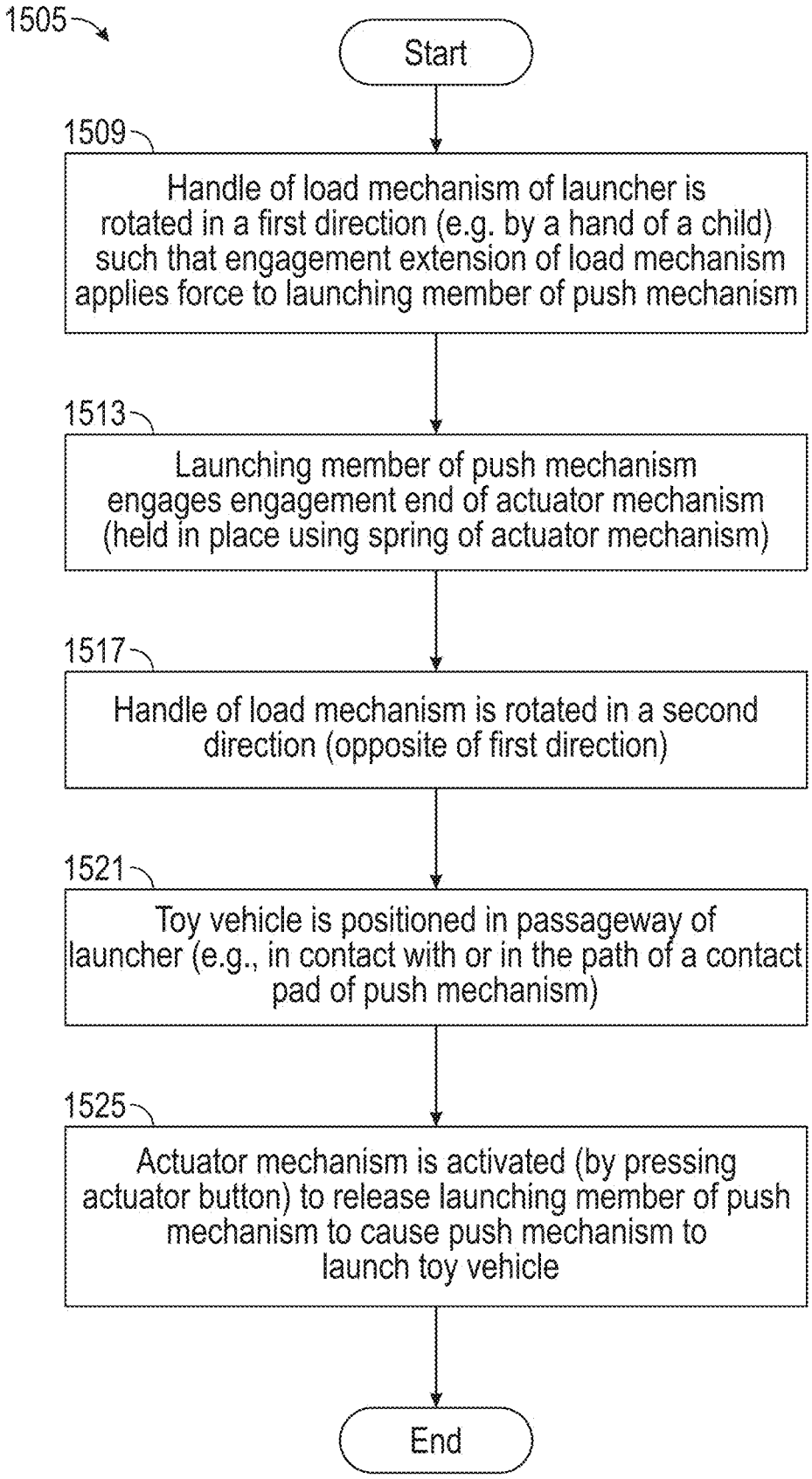
FIG. 4 is a process flow diagram illustrating a method of operating a toy vehicle launcher in accordance with an embodiment of the present application.

With reference to FIG. 4, one method of operating a toy vehicle launcher, e.g., overall launcher assembly 200 as described above, will be discussed in accordance with an embodiment. Toy vehicle launcher is generally a top-down launcher that is configured to be front-loaded, and is relatively easy to weight and/or leverage for loading purposes. A method 1505 of operating a toy vehicle launcher begins at a step 1509 in which an individual, e.g., a young child, prepares to launch a toy vehicle using the toy vehicle launcher by rotating a handle of a load mechanism of the launcher in a first direction such that an engagement extension of the load mechanism applies force to a launching member of a push mechanism. That is, the handle is used to move the launching member of the push mechanism towards an engagement end of an actuator mechanism, while also stretching a spring coupled to the launching member.

In a step 1513, the launching member of the push mechanism engages the engagement end of the actuator mechanism. A separate spring included in the actuator mechanism is placed under compression, as for example in a compressed state, to enable the launching member to engage the engagement end, and is in a substantially uncompressed state once the launching member and the engagement end are engaged or coupled, e.g., substantially locked together. In one embodiment, a protrusion such as an angled edge of the engagement end may be engaged with an inner lip, e.g., hook, overhang, associated with a receptacle space of the launching member. The handle is in a weighted position when the launching member of the push mechanism engages the engagement end.

In a step 1517, once the launching member is engaged with the engagement end and the handle of the load mechanism is released, a torsion spring connected to the load mechanism causes the handle to subsequently rotate in a second direction, or a direction opposite of the first direction. That is, the handle returns to a non-weighted position.

After the handle returns to the non-weighted position, a toy vehicle may be positioned in a step 1521 in a cavity or passageway of the launcher. In other words, a toy vehicle may be placed in a cavity to prepare the toy vehicle to be launched. The toy vehicle may be positioned in the cavity either in contact with, or in the path of, a contact pad of the launching member such that upon a propulsion force being applied to the launching member, the contact pad may contact the toy vehicle and launch the toy vehicle out of the cavity.

In a step 1525, the actuator mechanism is activated, as for example by activating an actuator button of the actuator mechanism, to effectively release the launching member of the push mechanism and cause the launching member to launch the toy vehicle. Activating an actuator button may include, but is not limited to including, pressing, pushing, depressing, engaging, triggering, applying pressure to, and/or otherwise applying a physical force to the actuator button. In one embodiment, activating the actuator button may cause a spring of the actuator mechanism to compress such that the launching member of the push mechanism is released from the engagement end of the actuator mechanism. A launching force is created as the spring connected to the launching member pulls the launching member back to its original position. Upon the push mechanism launching the toy vehicle, the method of operating the toy vehicle launcher is completed and may be repeated to launch additional toy vehicles.

In some aspects, the techniques described herein relate to a toy vehicle launcher assembly including: a housing; and a launcher at least partially disposed in the housing, the launcher including: a load mechanism, the load mechanism including a handle portion and a extension, the handle portion configured to move the extension; an actuator mechanism, the actuator mechanism including an actuator button, a spring, and a first end having a first protrusion disposed thereon; and a push mechanism, the push mechanism having a launching member, the launching member having a receptacle space defined therein, the launching member further having a second protrusion associated with the receptacle space, wherein the extension is positioned to move the launching member along a first axis to cause the first protrusion to be retained within the receptacle space by the second protrusion when the launcher is prepared to launch a toy vehicle.

In other aspects, the techniques described herein relate to a toy vehicle launcher including: a load mechanism; a push mechanism including an launching member, the launching member including a receptacle and a first protrusion, wherein the load mechanism is configured to cause the launching member to move along a first axis in a first direction; and an actuator mechanism, the actuator mechanism including an actuator button, a spring, and an engagement end having a second protrusion, wherein when the second protrusion is disposed within the receptacle and in contact with the first protrusion, the push mechanism is prepared to launch a toy vehicle along the first axis, and wherein when the actuator button is pressed while the second protrusion is disposed within the receptacle and in contact with the first protrusion, the spring is arranged to compress along a second axis to release the launching member and to cause a launching force to be imparted on the launching member to cause the launching member to move along the first axis in a second direction, the second direction being opposite from the first direction.

In yet other aspects, the techniques described herein relate to a toy vehicle launcher assembly including: a housing; a base, wherein the housing is coupled to the base; and a launcher at least partially disposed in the housing and atop the base, the launcher including: a load mechanism; an actuator mechanism including an engagement end having a first protrusion disposed thereon; and a push mechanism including an launching member having receptacle and a second protrusion, wherein the load mechanism is configured to cause the first protrusion to become captured in the receptacle and restrained by the second protrusion by moving the launching member in a first direction along an x-axis, and wherein the actuator mechanism is configured to cause the first protrusion to be released from the receptacle by applying a force in a second direction along a z-axis and to cause a launching force to be imparted on the launching member in a third direction along the x-axis, the third direction being opposite of the first direction.

While only a few embodiments have been described in this disclosure, it should be understood that the disclosure may be embodied in many other specific forms without departing from the spirit or the scope of the present disclosure. By way of example, the configurations of an engagement end of an actuator mechanism and a launching member of a push mechanism may vary. In other words, the geometry associated with an engagement end and a launching member is not limited to the geometry shown in the various figures.

In another example, the toy vehicle launcher may have two push mechanisms that are both loaded by a single load mechanism. The two push mechanisms are positioned parallel to each other and allow for two toy vehicles to be launched simultaneously. Rotating the handle of the load mechanism causes the launching members of each push mechanism to engage with an actuator mechanism. Activating the actuator mechanism causes both launching members to be simultaneously released to launch the toy vehicles.

It is to be understood that the toy vehicle launcher including the same described herein, or portions thereof, may be fabricated from any suitable material or combination of materials, such as plastic, foamed plastic, wood, cardboard, pressed paper, metal, supple natural or synthetic materials including, but not limited to, cotton, elastomers, polyester, plastic, rubber, derivatives thereof, and combinations thereof. Suitable plastics may include high-density polyethylene (HDPE), low-density polyethylene (LDPE), polystyrene, acrylonitrile butadiene styrene (ABS), polycarbonate, polyethylene terephthalate (PET), polypropylene, ethylene-vinyl acetate (EVA), or the like. Suitable foamed plastics may include expanded or extruded polystyrene, expanded or extruded polypropylene, EVA foam, derivatives thereof, and combinations thereof.

It is also to be understood that terms such as "left," "right," "top," "bottom," "front," "rear," "side," "height," "length," "width," "upper," "lower," "interior," "exterior," "inner," "outer" and the like as may be used herein, merely describe points or portions of reference and do not limit the present invention to any particular orientation or configuration. Further, the term "exemplary" is used herein to describe an example or illustration. Any embodiment described herein as exemplary is not to be construed as a preferred or advantageous embodiment, but rather as one example or illustration of a possible embodiment of the invention.

Although the disclosed inventions are illustrated and described herein as embodied in one or more specific examples, it is nevertheless not intended to be limited to the details shown, since various modifications and structural changes may be made therein without departing from the scope of the inventions and within the scope and range of equivalents of the claims. In addition, various features from one of the embodiments may be incorporated into another of the embodiments. Accordingly, it is appropriate that the appended claims be construed broadly and in a manner consistent with the scope of the disclosure as set forth in the following claims.

What is claimed is:

1. A toy vehicle launcher assembly, comprising:

a housing; and a launcher at least partially disposed in the housing, the launcher including:

a load mechanism, the load mechanism including a first arm with a handle portion and a second arm with an engagement extension, the handle portion configured to pivot along a first axis to move the engagement extension, wherein a length of the first arm is longer than a length of the second arm;

an actuator mechanism, the actuator mechanism including a catch; and a push mechanism, the push mechanism including a launching member having a first end for engaging with the catch, a second end opposite the first end for engaging a toy vehicle, and a protrusion extending from the launching member proximate to the first end, the protrusion having a stop member that can engage the housing to limit the movement of the launching member, wherein rotating the handle portion of the load mechanism towards the push mechanism causes the engagement extension to engage the protrusion to move the launching member laterally towards the actuator mechanism so that the first end engages with the catch.

2. The toy vehicle launcher assembly of claim 1, wherein the push mechanism further comprises a biasing member coupled to the launching member and the housing, the biasing member configured to bias the launching member away from the actuator mechanism to a default position.

3. The toy vehicle launcher assembly of claim 2, wherein the first end of the launching member includes a raised lip configured to engage with a protrusion on the catch when the launching member is moved into a loaded position.

4. The toy vehicle launcher assembly of claim 3, wherein:

the actuator mechanism includes an actuator button for operating the catch;

the catch includes a spring that is arranged to compress to enable the protrusion to engage with the raised lip of the launching member;

the spring is further arranged to decompress when the protrusion is engaged with the raised lip to retain the launching member in the loaded position; and pressing the actuator button when the launching member is in the loaded position causes the catch to release the launching member and allow the launching member to return to the default position.

5. The toy vehicle launcher assembly of claim 1, wherein the second end of the launching member further includes a contact pad comprising an array of conical protrusions.

6. The toy vehicle launcher assembly of claim 1, wherein the load mechanism further includes a torsion spring configured to rotationally bias the handle portion away from the push mechanism and the engagement extension away from the actuator mechanism.

7. The toy vehicle launcher assembly of claim 1, wherein the push mechanism further includes a second launching member and rotating the handle portion of the load mechanism towards the push mechanism moves both launching members laterally towards the actuator mechanism.

8. The toy vehicle launcher assembly of claim 1, further including a base, wherein the housing is coupled to the base, the base being arranged to be coupled to at least one track piece.

9. The toy vehicle launcher assembly of claim 3, wherein the housing includes a stop pad, the stop pad positioned to contact and stop movement of the launching member after the launching member moves from the loaded position to the default position.

10. The toy vehicle launcher assembly of claim 1, wherein the load mechanism is not coupled to the push mechanism, and the load mechanism includes a torsion spring that rotates the load mechanism so that the engagement extension no longer abuts or is in contact with the launching member.

11. A toy vehicle launcher, comprising:

a load mechanism;

a push mechanism, the push mechanism including a launching member and a biasing member, the launching member including a protrusion with a receptacle with an inner lip, wherein the load mechanism is configured to engage the protrusion to move the launching member along a first axis in a first direction; and an actuator mechanism, the actuator mechanism including an actuator button, a spring, and an engagement end having an angled edge, wherein when the angled edge is disposed within the receptacle and engaged with the inner lip, the push mechanism is prepared to launch a toy vehicle along the first axis, and wherein when the actuator button is pressed while the angled edge is disposed within the receptacle and engaged with the inner lip, the spring is arranged to compress along a second axis to release the launching member and allow the biasing member to cause the launching member to move along the first axis in a second direction, the second direction being opposite from the first direction.

12. The toy vehicle launcher of claim 11, wherein the load mechanism includes a rotational component and an engagement extension coupled to the rotational component, the rotational component being arranged to be rotated about a third axis in a third direction to cause the engagement extension to move the launching member laterally along the first axis in the first direction.

13. The toy vehicle launcher of claim 12, wherein the load mechanism further includes a handle coupled to the rotational component.

14. The toy vehicle launcher of claim 13, wherein the load mechanism further includes a torsion spring configured to rotate the engagement extension in a fourth direction opposite to the third direction without moving the launching member.

15. The toy vehicle launcher of claim 11, wherein the launching member further includes a contact pad, the contact pad including an array of protrusions configured to contact a toy vehicle while the toy vehicle is being launched by the push mechanism.

16. A toy vehicle launcher assembly, comprising:

a housing;

a base, wherein the housing is coupled to the base; and a launcher at least partially disposed in the housing and atop the base, the launcher including:

a load mechanism including a rotational component, the rotational component having a handle portion and an engagement extension;

an actuator mechanism including an engagement end with a catch disposed thereon; and a push mechanism including a launching member having a protrusion with a receptacle with an inner lip and a biasing member coupled to the launching member and the housing, wherein the load mechanism is configured to engage the protrusion to move the launching member in a first direction along an x-axis such that the engagement end of the actuator mechanism is inserted into the receptacle of the protrusion and the catch engages the inner lip, and wherein the actuator mechanism is configured to disengage the catch from the inner lip when a force is applied to the actuator mechanism in a second direction along a z-axis, thereby allowing the biasing member to impart a launching force on the launching member in a third direction along the x-axis, the third direction being opposite of the first direction.

17. The toy vehicle launcher assembly of claim 16, wherein the engagement extension is curved and slides along a side of the receptacle while the load mechanism moves the launching member in the first direction.

18. The toy vehicle launcher assembly of claim 16, wherein the housing includes a stop pad for stopping movement of the launching member in the third direction when the launching member comes into contact with the stop pad.

19. The toy vehicle launcher assembly of claim 16, wherein the housing includes an axial pin, and wherein the rotational component rotates about the axial pin to cause the engagement extension to push the receptacle of the launching member.

20. The toy vehicle launcher assembly of claim 19, wherein rotating the handle portion of the load mechanism towards the launching member causes the engagement extension to move the launching member laterally in the first direction.

* * * * *